United States Patent [19]

Terbrack et al.

[11] 4,426,820

[45] Jan. 24, 1984

[54] PANEL FOR A COMPOSITE SURFACE AND A METHOD OF ASSEMBLING SAME

[76] Inventors: Heinz Terbrack; Josef Terbrack, both of Ölbachstr. 50, 4426 Vreden, Fed. Rep. of Germany

[21] Appl. No.: 235,316

[22] Filed: Feb. 17, 1981

[30] Foreign Application Priority Data

Apr. 24, 1979 [DE] Fed. Rep. of Germany ..... 7911924
Oct. 9, 1979 [DE] Fed. Rep. of Germany ..... 7928703

[51] Int. Cl.[3] ..... E04C 1/10; E04C 1/30

[52] U.S. Cl. ..... 52/594; 52/584; 52/586

[58] Field of Search ..... 52/594, 595, 584–586, 52/591, 741

[56] References Cited

U.S. PATENT DOCUMENTS

| | | | |
|---|---|---|---|
| 1,776,188 | 9/1930 | Langbaum | 52/595 |
| 2,282,559 | 5/1942 | Byers | 52/584 |
| 2,808,624 | 10/1957 | Sullivan | 52/584 |
| 4,074,496 | 2/1978 | Fischer | 52/586 |
| 4,242,390 | 12/1980 | Nemeth | 52/594 X |

FOREIGN PATENT DOCUMENTS

| | | | |
|---|---|---|---|
| 2159042 | 6/1973 | Fed. Rep. of Germany | 52/594 |
| 1215852 | 4/1960 | France | 52/594 |

*Primary Examiner*—J. Karl Bell
*Attorney, Agent, or Firm*—Felfe & Lynch

[57] ABSTRACT

A panel interconnectable with like panels for use in forming a sports surface has a substantially rectangular and planar member and an edge connector at at least one set of opposite edges including a first locking member extending from the lower surface of the panel at one edge and having a groove extending inwards from the end thereof and towards the one edge and terminating below the upper surface. A second locking member extending from the upper surface of the panel at the other edge, has a projection configured to engage in the groove to mate with the first locking member at the one edge of an adjacent panel to align the upper and lower surfaces of the panels. A plurality of these panels are advantageously assembled by the method according to the present invention to form a sports surface.

10 Claims, 26 Drawing Figures

PANEL FOR A COMPOSITE SURFACE AND A METHOD OF ASSEMBLING SAME

BACKGROUND OF THE INVENTION

The present invention relates to a sports ground (surface) to be assembled from separate panels, for skating, bowling and the like; in particular, the invention relates to a panel having connector means at the edges for interconnecting or joining separate panels, as well as a method of assembling a sports ground or (running) course from such panels.

Conventional running courses or sports grounds of plastic are produced from individual sections in order to facilitate transportation to the assembling site. The separate sections are connected to each other by welding. Assembling and connecting involves a relatively high expenditure of time so as to result in extremely high cost.

SUMMARY OF THE INVENTION

It is an object of the present invention to provide components for assembling a sports ground (surface), preferably from plastics material, which greatly reduces or even eliminates the expenses for maintenance and service and the construction of which is of such type that a perfectly planar sports ground surface is obtained. For example, skating-rinks require to be constantly maintained and serviced, and relatively high expenses are required for properly cooling the skating-rink particularly in summer. The invention contemplates to at least substantially reduce all these costs.

Further, it is an object of the present invention to form the separate panels in such a way that extra clamping elements are not necessary, while nevertheless permitting the panels to be assembled into a course or an large-area sports ground.

According to the present invention, this object is achieved in that said panel includes, in the Y direction, means to form a groove and tongue joint with an adjacent panel, that a connction or joint preventing displacement is provided between adjacent panels in the direction. The connection comprises a recess or groove formed in the edge of one of the adjacent panels above which a protruding nose or lug is provided which joins said recess through an inclined face such that said recess defines a cavity having the shape of a truncated wedge surface. Between said recess and said panel edge there is provided a raised part the upper edge of which extends in parallel with the panel surface and which terminates in an inclined face in front of said recess. The edge configuration of the adjacent panel is such that this panel engages into the edge configuration of the first mentioned panel in such a manner that, for example, the projection engages into said recess of said first mentioned panel. This defines between both panels a joint preventing displacement between both panels. Furthermore, said edge has formed therein in the X direction, in front of the end face of said panel, a recess approximately in the region of the neutral zone of said panel. A clip or clamp is adapted to be driven into said recess, which clamp simultaneously engages into a corresponding or complementary recess of the laterally adjoining panels, so as to form a clamping connection between the adjacent or adjoining panels in the X direction. Another embodiment is characterized in that a groove or indentation is provided in front of said recess, said groove or indentation allowing a clamp to be driven into the panel(s).

According to a further embodiment, the invention is characterized in that the profiled or sectioned edges of the panel, acting as connecting means, are provided on all edges with the exception of the edge panels, whereby a junction cross of the groove-shaped recesses is formed at the corners of the panels.

The technical advance of the invention resides in the fact that problems in the production of the panels, regarding their shape and the connector means, are avoided, and that assembly of the sports ground is extremely easy, while the panels are secured to each other in such a manner that relative displacement cannot occur. As the panels forming the sports ground are made of plastics material, the sports ground requires little maintenance. It is sufficient that the sports ground is periodically cleaned from dust and dirt.

Expediently, the panels are laid on a solid substrate which may consist of concrete or macadam. In many instances, it may be advantageous to interpose an elastic layer between the plastic panels and the supporting surface, which layer may be formed, for instance, from plastic foam.

The art of preparation of plastics materials has reached such an advanced state that it is readily possible to employ a plastics material which can withstand even the stresses exerted by skating.

In one embodiment of the invention, the inclined faces which laterally define the recess provided in the panel, are of different inclinations so as to form a wedge-shaped recess, preferably of such configuration that one inclined face has a greater inclination than the other inclined face. In this embodiment the panels may be locked on each edge thereof without the use of special clamping means.

In still another embodiment which does not utilize a wedge-type clamping effect, the panel edge in the area of the panel surface includes a greatly protruding nose or lug having the front portion of the lower side thereof provided with a recess the front end face of which is defined by an inclined face, said inclined face joining a surface extending in parallel with the upper edge of the panel such that the thus formed protrusion defines a nose or lug the lower side of which joins a surface extending in parallel with the upper edge of the panel and which, finally, includes a further nose or lug at the tip thereof, while the adjacent panel is provided with a recess acting to receive the protrusion of the (first) panel and which, further, includes at the front portion thereof a projection originating from an inclined face and engaging into the recess of the other (opposite) panel. In one embodiment of this edge configuration, the recess formed in one panel shows at the inner end thereof a vertical surface above which an outwardly protruding nose or lug having horizontal and vertical end faces, so as to define an approximately rectangular recess into which the other (opposite) panel engages. This edge configuration offers the possibility to join the panels to each other in either direction without the use of specific clamping elements. This configuration is of particular advantage for the reason that slight variations from the contemplated shape of the edge configuration are insignificant, such that this edge configuration is particularly well suited for panels made of plastics material.

In a third embodiment being principally similar to the second embodiment, both panel edges are provides with an arc-shaped or curved recess or a curved projection, respectively, which are engaged with each other in assembling the panels. This embodiment provides for further facilitated joining of the panels.

Needless to say, all embodiments of the invention offer the possibility of joining the panels in only one direction or in either direction, such that courses of lesser width or even sports grounds of greater area may be assembled as desired.

According to the present invention, joining of the panels is performed by initially providing a separate panel, then inserting a second panel, in included position, into the groove of said first panel, subsequently engaging, while maintaining said included position, a third panel into said second panel, and upon joining said second and third panels in their inclined position, simultaneously lowering both panels into a horizontal position, etc..

Below, embodiments of the present invention are described in greater detail by referring to the drawings, wherein:

DETAILED DESCRIPTION OF THE PREFERRED EMBODIMENTS

Figure 1:
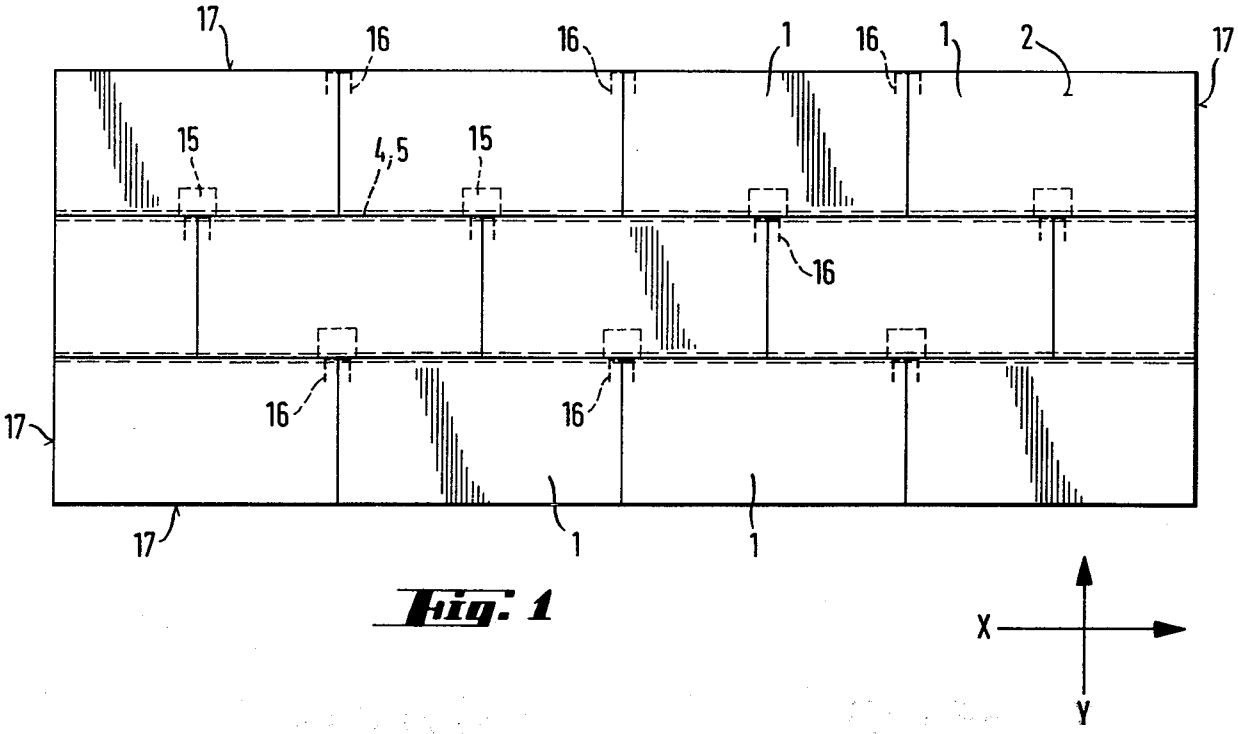
FIG. 1 is a schematical view showing the arrangement of the individual panels for forming a sports ground.

FIG. 1 is a schematical presentation of a sports ground comprising a plurality of panels 1 which are arranged in three rows. Numerals 4, 5 indicate the end edges of individual panels in the X direction. Numerals 16 indicate clips or clamps for clamping the panels in the X direction. The arrangement of the clips or clamps will be explained below. Numeral 17 indicates the smooth or uncontoured edges of corner panels. In the lower right hand portion, a coordinate system indicating the X and Y directions is given.

Figure 3:
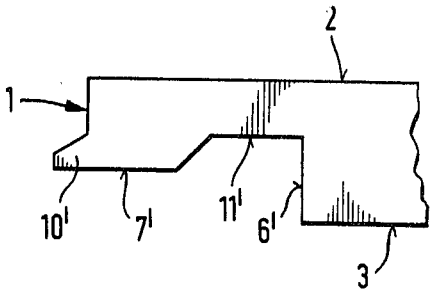
FIG. 3 shows the complementary edge configuration of a panel associated with the edge configuration according to FIG. 2.
Figure 2:
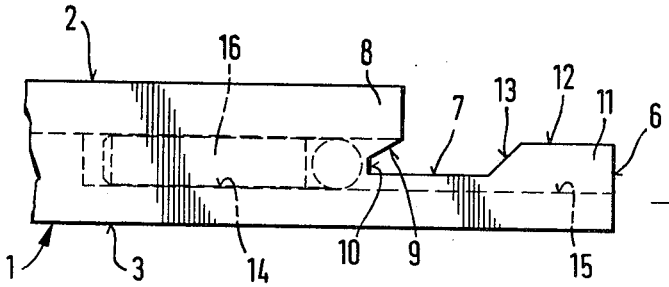
FIG. 2 shows the edge configuration of a panel in the area extending in the X direction.
Figure 5:
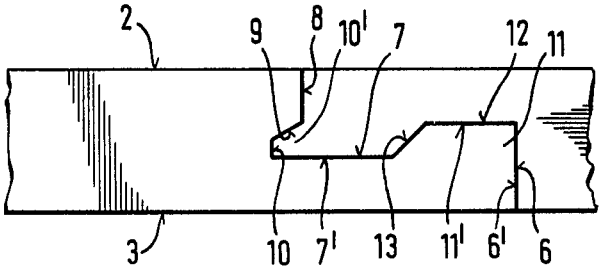
FIG. 5 is a schematical view of the panel edges according to FIGS. 2 and 3 in their joined position.

FIG. 2 illustrates in more detail the construction of a panel edge in the X direction. In this Figure, numeral 2 designates the panel surface, and numeral 3 indicates the panel underside. In the area of the panel edge 6, a recess 7 is formed which is defined at one side by a protruding edge 8 terminating at a lower part in a blunt or truncated wedge-shaped projection 10', with the transition from the vertical face to the truncated wedge being defined by an inclined face 9. At the side of the panel edge, there is provided a raised portion 11 the surface 12 of which extends in parallel with the panel surface 2. An inclined face 13 is provided between surface 12 and recess 7. In FIG. 3, the complementary edge structure or configuration of the adjacent (mating) panel 2 is shown, wherein a projection 10' is formed to be complementary to the wedge-sharped recess 10. Recess 7 of FIG. 2 has its counterpart in a projection 7' according to FIG. 3. A recess 11' is complementary to the raised portion 11 of FIG. 2, and an edge 6' (FIG. 3) is complementary to edge 6 of FIG. 2. In the view of FIG. 5, the panel edges are shown in their joined state.

Figure 4:
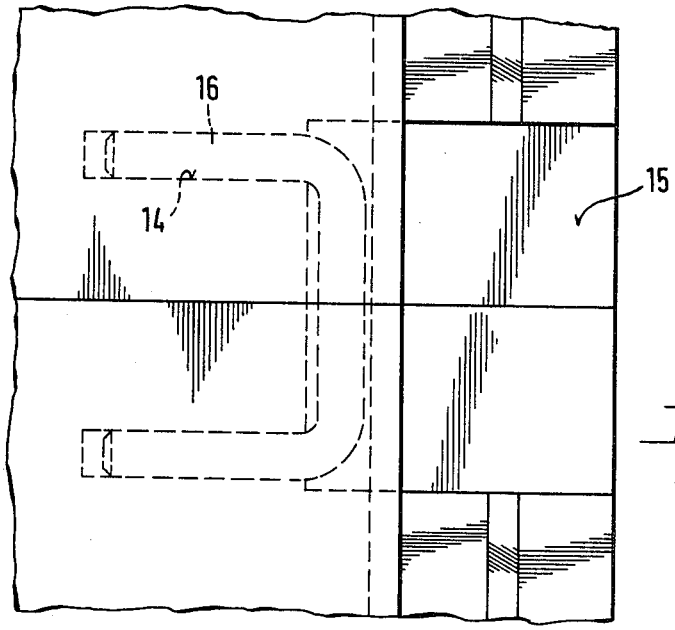
FIG. 4 is a plan view showing the positioning of a clip or clamp disposed between a pair of panels.
Figure 6:
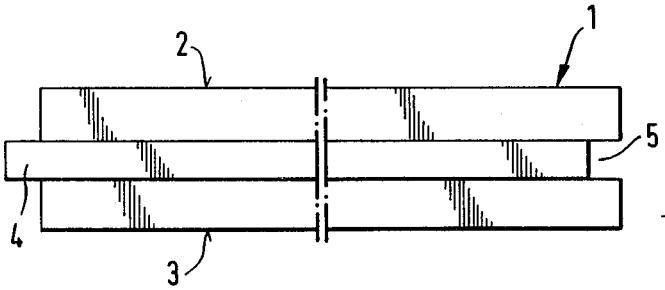
FIGS. 6 and 7 show the means forming a groove and tongue joint between a pair of panels.
Figure 7:
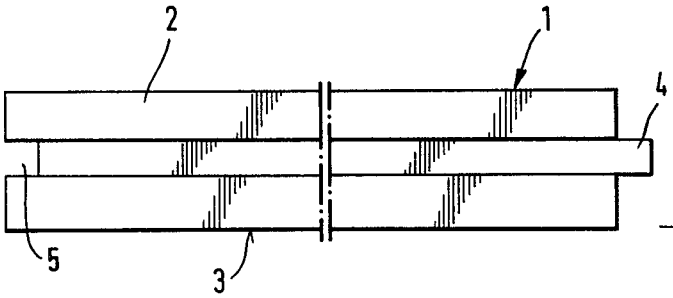

FIG. 4 shows a clamping structure between a pair of adjacent panels. In order that the clamping means 16 may be driven into the panels, adjacent panels have a recess or hole 14 each. In order to facilitate insertion of the clamping means 16, the panels each have in front of the opening part of each hole 14 a recessed space 15 through which the clamp 16 may be inserted. FIG. 2 illustrates the inserted clamp 16 in side elevational view. The broken line in FIG. 2 indicates the surface within the recess or hole. FIGS. 6 and 7 illustrate a groove and tongue 4,5 to form joint, which are arranged in the Y direction.

Figure 8:
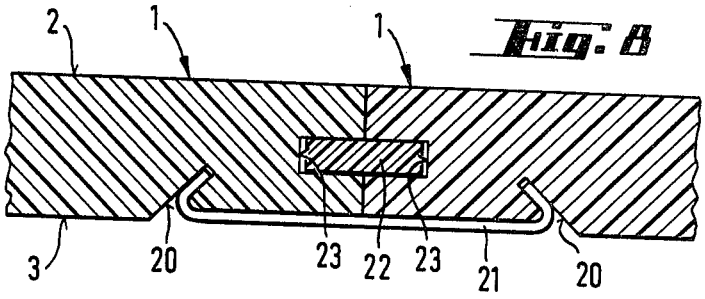
FIGS. 8 to 10 are sectional views of three alternatives for joining adjacent panels with the use of groove and tongue joint, dovetailing and clips or clamps of various constructions.
Figure 9:
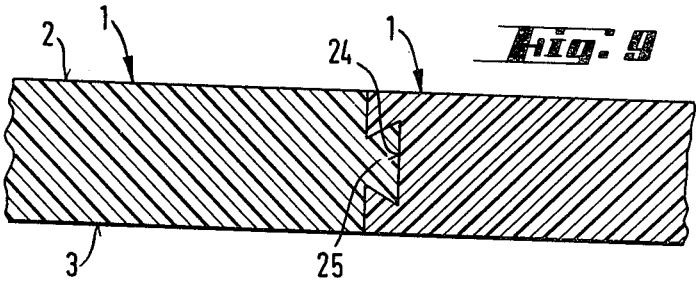
Figure 10:
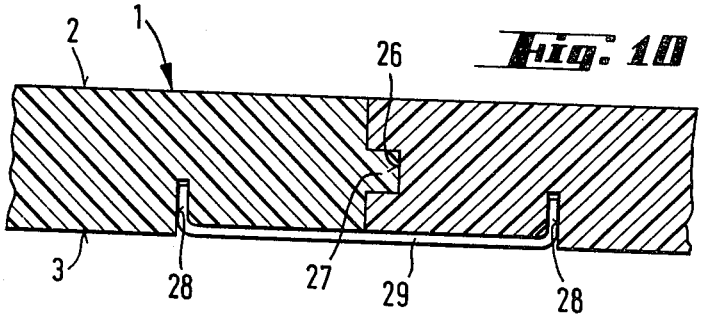

The showings of FIGS. 8 to 10 illustrate various alternatives for joining the panels either in the Y direction or in the X direction, wherein various connector means may be used in the respective directions of of the edges in accordance with the basic object.

FIG. 8 shows a joining structure of panels 1 wherein recesses or grooves 23 and inserts 22 are provided in the direction of the neutral fiber, so as to form a groove and tongue joint. The lower sides are provided with recesses or grooves 20 for receiving a clamp 21 which must not protrude beyond the lower plane of the panels on the underside thereof. FIG. 9 shows a known per se dovetail joint 24, 25. According to FIG. 10, a further connection or joint is provided wherein there are provided approximately in the area of the neutral fiber (in fiber direction), a groove 26 in one panel and a key 27 in the other panel, which elements are dimensioned so as to fit into each other with tight fit. Recesses or grooves 28 for receiving a clamp 29 are provided on the lower side of the panels.

It is also possible to produce, by mirror high frequency or electrode welding, transverse joints the length of which should be 1 meter at most.

Figure 11:
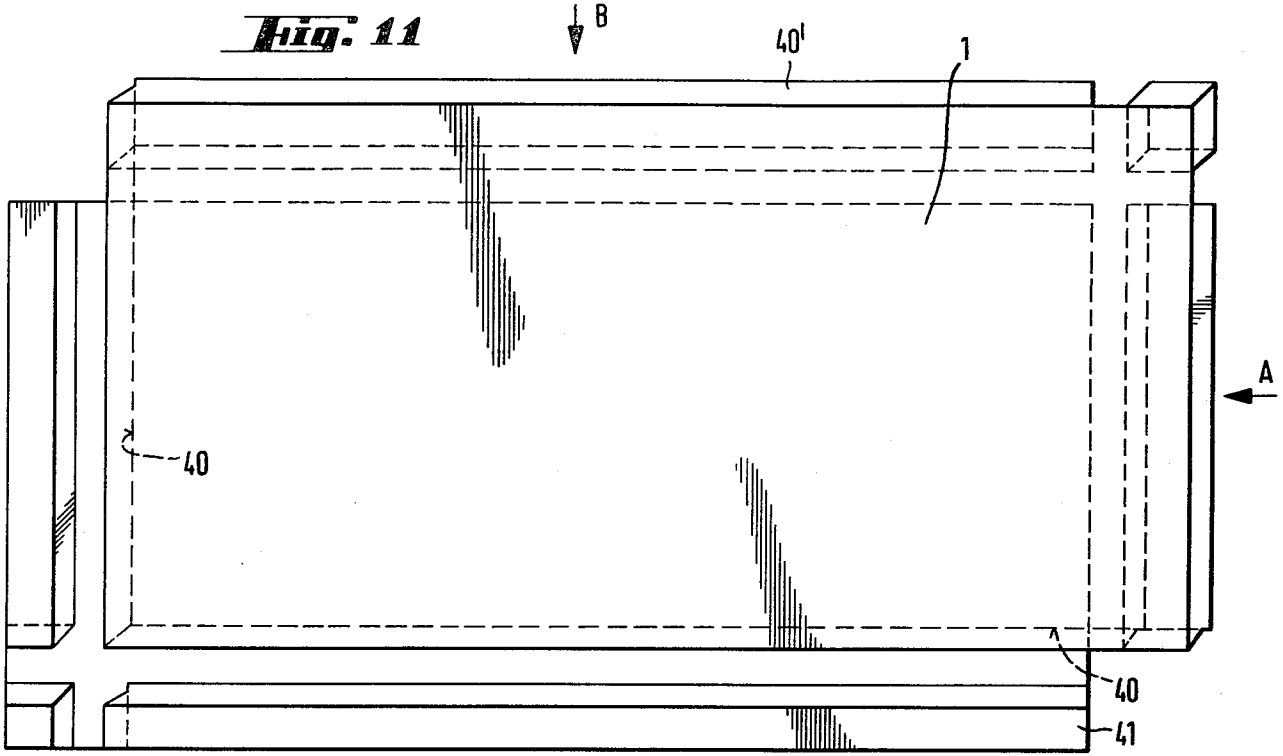
FIG. 11 is a plan view of a panel according to one embodiment, including directional arrows A and B.
Figure 13:
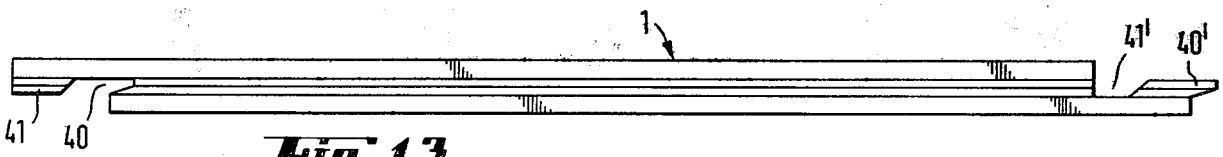
FIG. 13 is a schematical side elevational view as seen in the direction of arrow B in FIG. 11.
Figure 12:
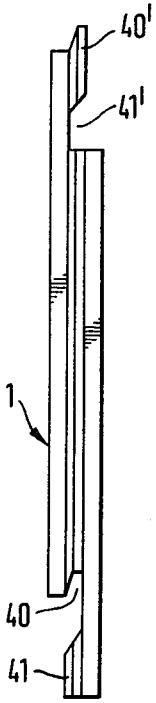
FIG. 12 is a schematical side elevational view, as seen in the direction of arrow A in FIG. 11.
Figure 14:
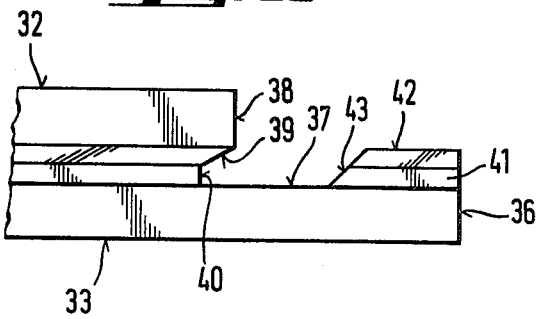
FIGS. 14 to 16 are illustrations of the edge configuration in the embodiment of FIG. 11.
Figure 15:
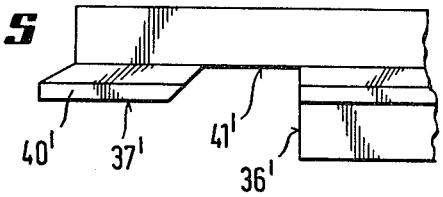
Figure 16:
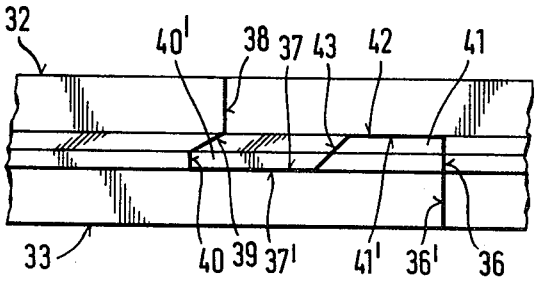

FIG. 11 is a plan view of another panel 1, with the edge structures being shown in greater detail in FIGS. 12 to 16. As can be seen, the profiled or sectioned structures are provided on either of the four panel edges, as appears from the view in direction A according to FIG. 12 and from the view in direction B according to FIG. 13. Obviously, panel edges according to FIGS. 12 and 13 may be joined by having projection 40' engage into the left hand recess according to FIG. 13, when the panel is rotated about 180° in FIG. 12. FIGS. 14 and 15 illustrate in side elevational view the actual configuration of the panel edges, and FIG. 16 shows particularly the manner in which the panels are joined. The upper panel, the upper part of which is designated with numeral 32, includes a recess 37 into which the projection 37' according to FIG. 15 engages such that nose or lug 40' engages into recess 40 of FIG. 14. As appears from the view, the inclined faces 39 and 43 are of different degrees of inclinations, such that the inclination of face 43 is steeper. In this manner, the side faces of recess 37 are imparted a wedge-shaped configuration which could be readily seen in faces 39 and 43 of the Figure were extended. Numeral 41 in FIG. 14 indicates a projection engaging into recess 41' of FIG. 15 when the panels are joined together. Upon joining, face 36 of FIG. 14 and face 36' of FIG. 15 are precisely matched to each other. The lower surface of the panel is shown at 33 in FIG. 14. Numeral 42 of FIG. 14 indicates that part which tightly or sealingly engages the complementary inclined face 41' of FIG. 15. Numeral 38 designates the vertical upper abument face.

Figure 17:
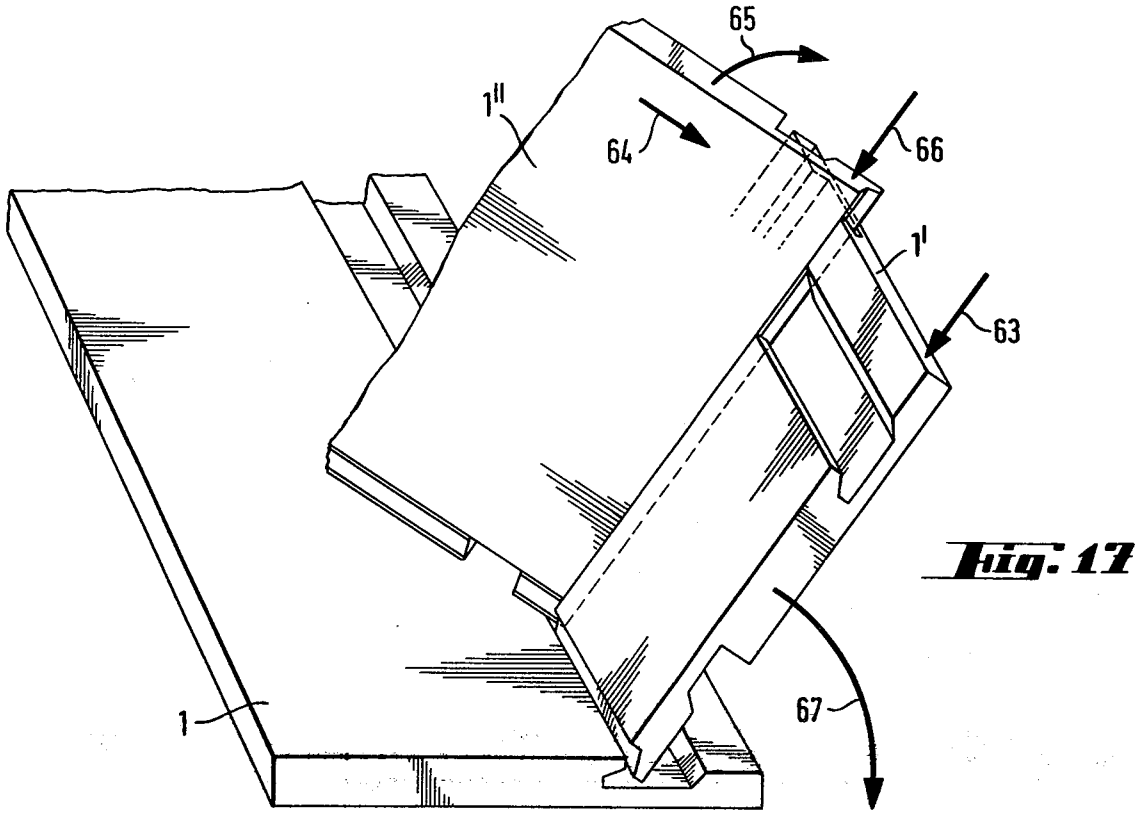
FIG. 17 is a perspective view illustrating the joining of three panels and indicating the movements during assembly.

FIG. 17 illustrates the method steps for joining three separate panels 1, 1' and 1''. The process starts with the insertion of panel 1' into the groove-shaped recess of panel 1 in the direction of arrow 63. Panel 1' is initially held in the illustrated inclined position such that panel 1'' may be inserted into the recess of panel 1' in the direction of arrow 64. Then, panel 1'' is slightly rotated in the direction of arrow 65, whereupon this panel is slightly rotated in the directions of arrows 65 and 66 until both panels 1' and 1'' assume the same inclined position. Hereupon, both panels 1' and 1'' may be lowered in the direction of arrow 67 until they assume the horizontal plane of panel 1. In the above described manner, a sports ground may be assembled from the panels. In general, assembling will be made such that the joints of the various strips (of panels) are staggered symmetrically.

Figure 18:
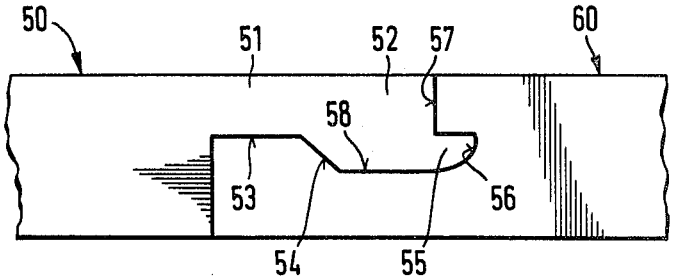
FIGS. 18 to 20 show in schematical view the edge configurations in a second embodiment and the assembling procedure in the joining of the panels, in which the edge structures only are shown without illustrating the remaining portions of the panels.
Figure 19:
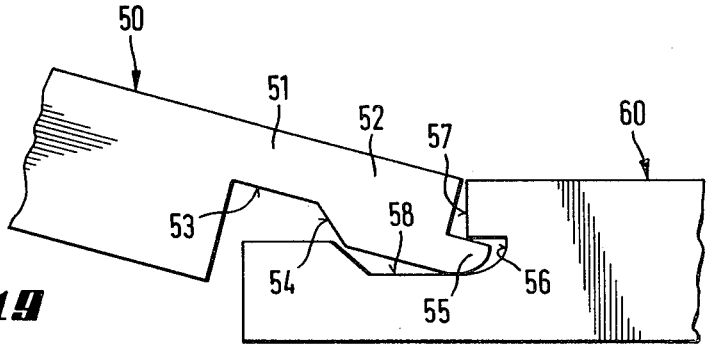
Figure 20:
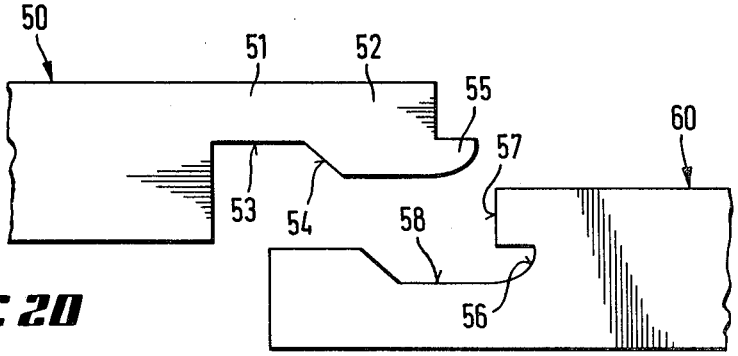

FIGS. 18 to 20 schematically show the second embodiment of an edge structure or configuration. In order to facilitate the presentation, only the edge structure as such is shown while the remaining portion of the panels is omitted. This embodiment differs from the preceding embodiment in that means providing a wedge-type effect could be omitted. Panel edge 50 includes an upper elongated projection 51, 52. A recess 53 is provided in portion 51. The projection of portion 52 is of increased thickness. Both portions 51 and 52 join each other through an inclined face 54 such that the other (opposite) panel 60 may engage into recess 53 with a complementary projection. Panel 60 has a correspondingly formed projection on the lower side, which projection forms a recess in portion 58 such that panel 50 may have a nose or lug 55 engaging into a recess 56 of panel 60 above which a rectangularly formed projection 57 extends. Engagement of projection 55 into recess 56 provides for secure anchoring between both panels 50 and 60. The presentation of FIG. 19 shows particularly that the panels 50 and 60 may be joined to each other in extremely easy manner.

Figures 21, 22, 23:
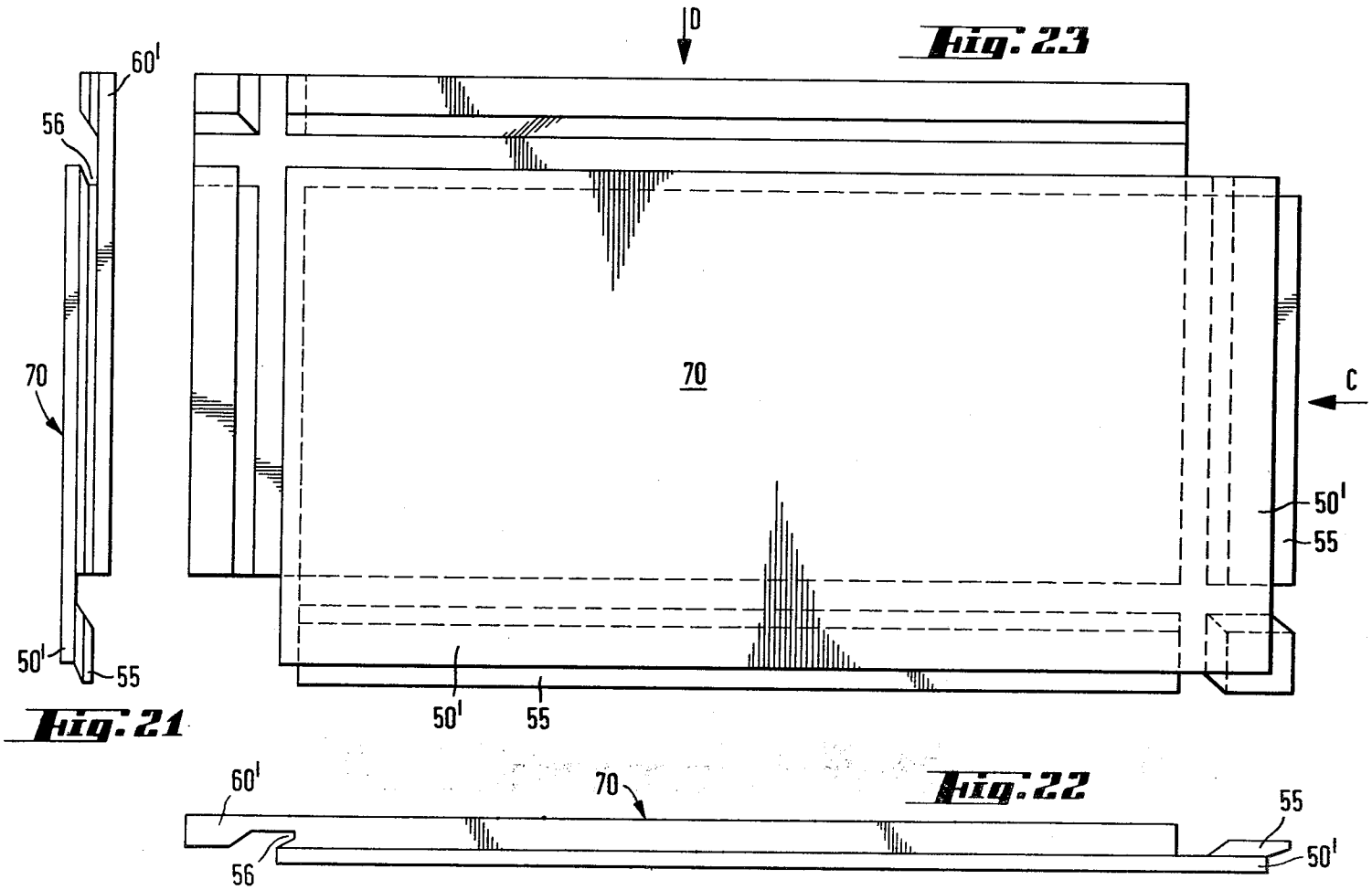
FIGS. 21 and 22 are side elevational views of a slightly modified alternative of the second embodiment, with the directions of view being shown in FIG. 23.
FIG. 23 is a plan view of another embodiment of a panel.

FIGS. 21 and 22 show an embodiment which is slightly different from the above described embodiment according to FIGS. 18 to 20. With respect to the structure shown in FIGS. 21 and 22, reference is made to FIG. 23. Thus, the presentation of FIG. 21 corresponds to the viewing direction C in FIG. 23, while the illustration of FIG. 22 is as seen in the direction D of FIG. 23. As appears from a comparsion with the views of FIGS. 18 to 20, this modification differs from FIGS. 18 to 20 by the feature that the projection 55, 56 is of substantially rectangular configuration. In order to facilitate the comparsion, the respective edge structures are designated with 50' and 60'. The modified embodiment of a panel according to FIG. 23 is designated with numeral 70.

Figure 24:
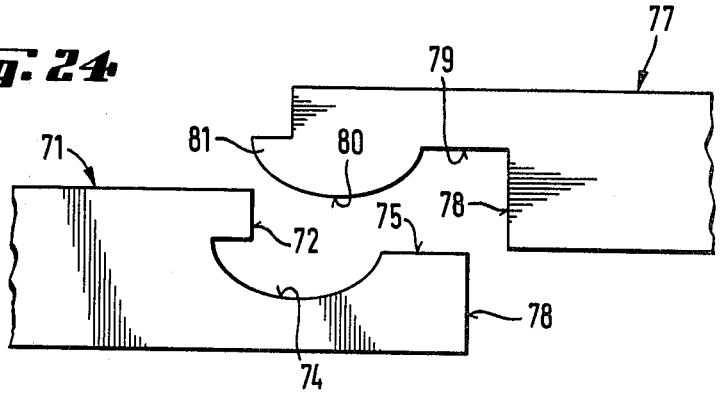
FIGS. 24 and 26 are schematical views of another embodiment of an edge configuration, in which the remaining portions of the panels are not illustrated.
Figure 25:
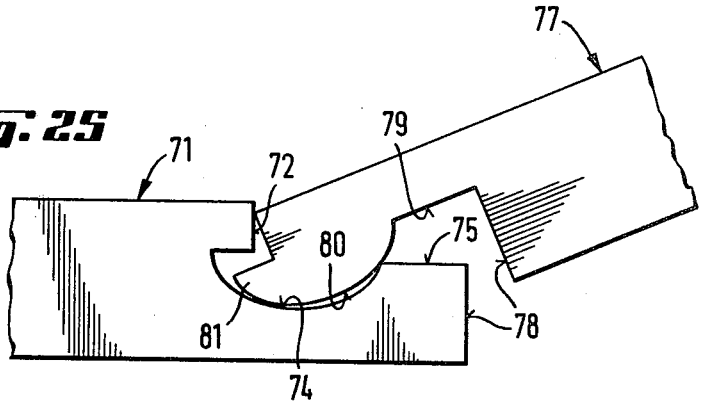
Figure 26:
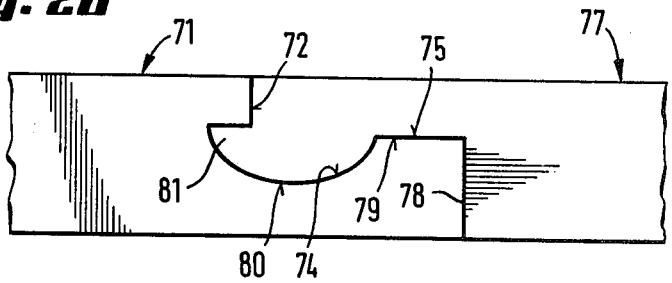

A final embodiment of an edge structure is shown in FIGS. 24 to 26. In this embodiment, joining of the panels is greatly facilitated in that panels 71 and 77 engage into each other with a curved recess 74 and a complementary projection 80, and panel 77 is provided with a projection 81 which engages into a complementary recess below the projection 72 of panel 71. In the case of panel 71, the recess 74 joins a projection 75 engaging into a recess 79, with both panels 71, 77 being provided with vertical end faces 78. The provision of the curved recess 74 and of the complementary projection 80 greatly facilitates insertion of panel 77.

What we claim is:

1. A panel interconnectable with similar panels for forming a surface, the panel comprising:

means for forming opposite, conncted, first and second surfaces having edges, at least the first surface being planer, whereby the first surface forms upon interconnection of the panel with similar panels a section of the first-mentioned surface;

a first locking member extending from the second surface of the panel along a first edge portion of the panel, the first locking member having a groove inwards of the first edge portion opening toward the first surface of the panel and terminating on its outer side therebelow, the groove having a planer base generally parallel to the first surface of the panel and inner and outer side walls generally angled similarly to the planer base, the inner side wall extending toward the outer side wall and having a portion which meets the planer base normally for forming, in combination with the planer base a truncated wedge space, the angle of the inner side wall to the planer base being smaller than that of the outer side wall; and a second locking member extending from the first surface of the panel along a second edge portion of the panel, the second locking member having a configuration facing the second surface of the panel matable with the first locking member, the configuration being positioned relative to the first surface of the panel such that the first surface of the panel would align with the same if the configuration were mated with the first locking member, whereby, when similar panels having mating edge portions are interconnected into the first-mentioned surface, the first-mentioned surface is planer.

2. The panel according to claim 1, and further comprising a recess correspondingly positioned at each locking member and configured to receive respective postions of a U-shaped clamp.

3. The panel according to claim 2, and further comprising an indentation in the second surface of the panel for receiving the central portion of the clamp.

4. The panel according to claim 3, and further comprising second means for forming a joint on other edge portions of the panel and recesses thereat extending obliquely to the first surface to receive a clamp having ends bent inwards.

5. The panel according to claim 1, and further comprising second means for forming a groove and tongue joint on other edge portions of the panel and recesses in the second surface of the panel adjacent and parallel to the other edge portions and extending normal to the first surface of the panel to receive a clamp.

6. The panel according to claim 4 or 5, wherein the first locking member and second means intersect at at least two corners of the panel.

7. The panel according to claim 1, wherein the inner side wall is arcuately convex.

8. The panel according to claim 1, wherein the panel is rectangular and comprising the first and second locking members on edge portions which intersect at at least two corners of the panel.

9. A kit for forming a surface somprising a plurality of panels according to claim 8.

10. A method of assembling a surface comprising providing, a first panel, then inserting a second locking member of a second panel in an inclined position into a first locking member of said first panel, subsequently engaging, while maintaining said inclined position, a second locking member of a third panel into a first locking member said second panel, and upon joining said second and third panels in their inclined position, inserting a second locking member of the third panel into the aforementioned first locking member of the first panel and simultaneously lowering both second and third panels into a horizontal position.

* * * * *